United States Patent [19]

Leonetti et al.

[11] Patent Number: 4,627,643

[45] Date of Patent: Dec. 9, 1986

[54] CONTEST CARD HAVING ELASTOMERIC COATING REMOVAL MEANS

[76] Inventors: Fred L. Leonetti; Richard L. Leonetti, both of P.O. Box 6622, Concord, Calif. 94519

[21] Appl. No.: 843,870

[22] Filed: Mar. 25, 1986

Related U.S. Application Data

[63] Continuation-in-part of Ser. No. 803,002, Nov. 29, 1985, abandoned.

[51] Int. Cl.[4] ..... B42D 15/00

[52] U.S. Cl. ..... 283/102; 283/903; 51/407; 51/211 R

[58] Field of Search ..... 51/181 R, 181 NT, 407, 51/281 R, 205 R, 310–312, 328; 273/139; 283/100, 101, 102, 903

[56] References Cited

U.S. PATENT DOCUMENTS

| | | | |
|---|---|---|---|
| 1,363,546 | 12/1920 | Aiken | 51/181 |
| 3,773,328 | 11/1973 | Seidman | 273/139 |
| 3,829,133 | 8/1974 | Romanoff | 283/102 |
| 3,900,219 | 8/1975 | D'Amato et al. | 283/6 |
| 4,095,824 | 6/1978 | Bachman | 283/6 |
| 4,241,942 | 12/1980 | Bachman | 283/6 |
| 4,398,708 | 8/1983 | Goldman et al. | 270/18 |
| 4,466,614 | 8/1984 | Bachman et al. | 273/139 |
| 4,491,319 | 1/1985 | Nelson | 273/1 R |

FOREIGN PATENT DOCUMENTS

| | | | |
|---|---|---|---|
| 0326480 | 6/1915 | France | 51/181 |
| 8100699 | 9/1982 | Netherlands . | |
| 598964 | 5/1978 | Switzerland . | |
| 1580768 | 12/1980 | United Kingdom . | |

*Primary Examiner*—Frederick R. Schmidt
*Assistant Examiner*—Robert A. Rose
*Attorney, Agent, or Firm*—Townsend and Townsend

[57] ABSTRACT

A contest card or ticket having an abrasive layer of material for removing elastomeric and other coatings, that are used to conceal indicia on contest cards, chance tickets, game cards, lottery tickets etc. This card consists of an abraded edge or spot on a portion of the contest card or ticket so that the card or ticket may be folded over or used independently to remove coating that conceals indicia, abraded edge also retains coating on card or ticket.

4 Claims, 12 Drawing Figures

CONTEST CARD HAVING ELASTOMERIC COATING REMOVAL MEANS

CROSS REFERENCES TO RELATED APPLICATIONS

This application is a continuation-in-part of U.S. application Ser. No. 803,002, filed Nov. 29, 1985, now abandoned.

BACKGROUND OF THE INVENTION

1. Field of the Invention

This invention relates to contest cards and a process for removing their concealing coatings.

2. Description of the Prior Art

Contest cards with indicia concealing coatings need a separate device, coin or fingernail to remove coating, when coating is scrapped off by a coin or fingernail the coating dispurses into the environment or floors, tables, under fingernails, etc. The coatings are of a sticking nature and are difficult to remove.

SUMMARY OF THE INVENTION

The object of the invention, therefore, is to provide an abrading method of removing these coatings from contest cards and retaining the coating on the contest card. The method is by putting an adhesive strip or spot on a portion of the contest card and applying sand or any form of grit or impressioning with a file surfaced type of tool into the contest card. A series of line cross match dots etc. as to make one portion of contest card abraded.

DETAILED DESCRIPTION OF DRAWINGS

Figure 1:
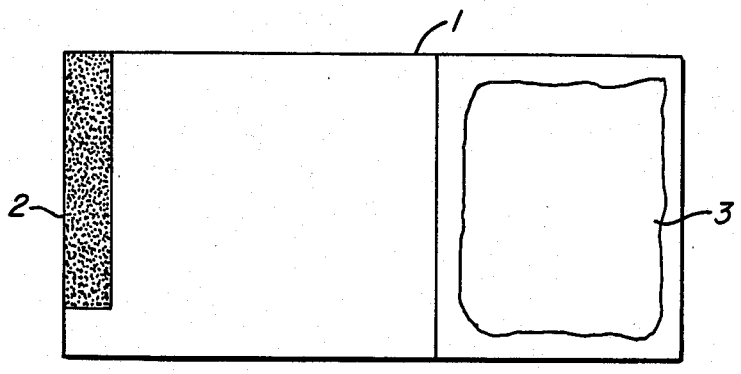
FIG. 1 shows contest card from a front view with abrading edge reference Number 1.

FIG. 1 shows contest card reference numeral 1 abraded area, reference numeral 2 and contest card coating reference Numeral 3.

Figure 2:
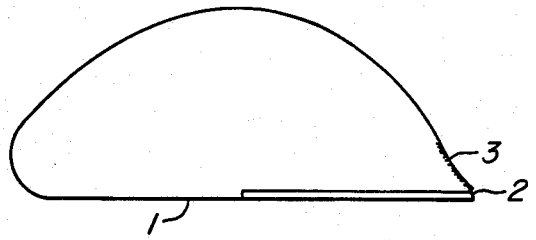
FIG. 2 shows contest card from side views, being folded from left to right and abraded edge placed on coating.

FIG. 2 shows contest card reference numeral 1. It also shows left side of contest card with abraded area reference Numeral 2 being folded over from left to right and being placed on contest card coating reference Numeral 3.

Figure 3:
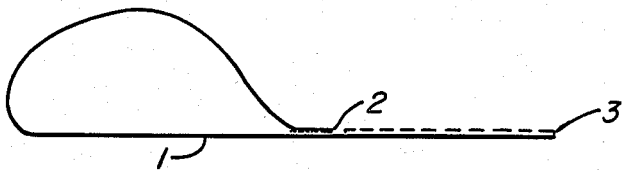
FIG. 3 shows contest card abraded edge reference Numeral 2 being rubbed over coating from right to left thus removing said coating and attaching it to abraded edge.
Figure 4:
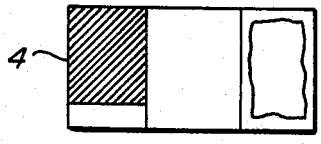
FIGS. 4, 5, 6, 7 and 8 show some possible designs and material applications for abraded area of contest card.
Figure 5:
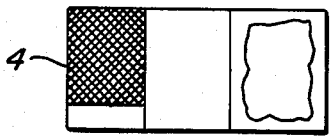
Figure 6:
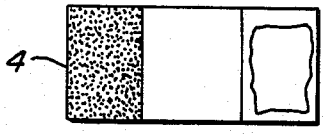
Figure 7:
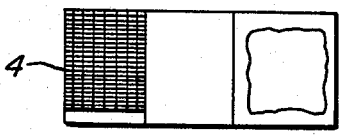

FIG. 3 shows contest card reference numeral 1 after left side of card with abraded area. Reference numeral 2 has been rubbed across portion of contest card that contains coating. Reference numeral 3 with a combination of friction which creates heat, the coating fuzes together is removed and is deposited on abraded area reference numeral 2.

FIGS. 4, 5, 6, 7 shows type of design for abraded area that would be impressioned by a file surfaced type of tool into the contest card thus creating an abrading surface, abraded surface appears on left sides, reference numeral 4.

Figure 8:
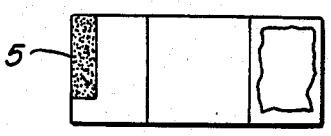

FIG. 8 shows abrading edge reference numeral 5 but instead of impressioned like reference numerals 4,5,6, and 7. The abraded edge is made out of sand or any type of grit secured by an adhesive, the same method of coating removal as shown in FIGS. 1, 2, 3, is used by both impressioning abraded edge into contest card and applying sand or grit to one portion of contest card as to make it abraded.

Figure 9:
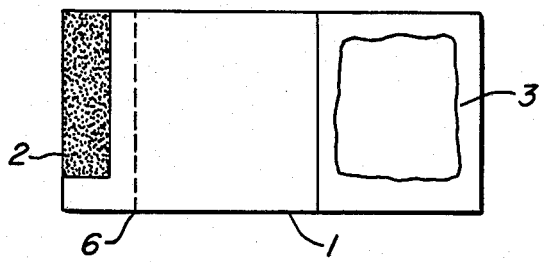
FIGS. 9, 10, 11 and 12 show how abraded portion of contest card may be used independently to remove coating from said card and attach said coating to said abraded portion.

FIG. 9 shows contest card from a front view reference numeral 1, abraded area reference numeral 2, perforation/detachment line reference numeral 6, and contest card coating reference numeral 3.

Figure 10:
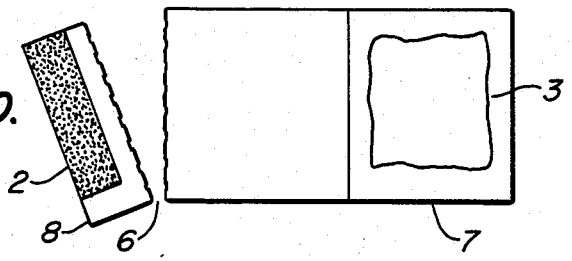

FIG. 10 shows contest card front view, with right side reference numeral 7, containing contest card coating reference numeral 3, separated from contest card left side reference numeral 8, containing abraded area reference numeral 2, with such separation achieved by tearing contest card right and left sides apart at contest card perforation/detachment line reference numeral 6.

Figure 11:
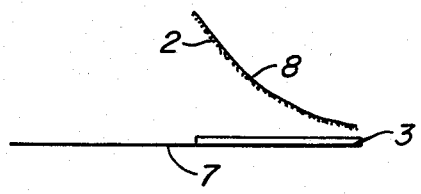

FIG. 11 shows contest card from side view, with separated left side reference numeral 8, containing contest card abraded area reference numeral 2, placed on contest card coating reference numeral 3, said coating being on contest card separated right side reference numeral 7.

Figure 12:
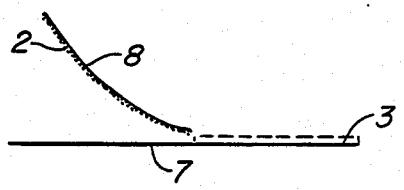

FIG. 12 shows contest card from side view, after separated left side reference numeral 8, containing contest card abraded area reference numeral 2, has been rubbed from right to left across separated right side of contest card reference numeral 7, removing contest card coating reference numeral 3, and depositing and fusing said coating onto contest card abraded area reference numeral 2, by a combination of friction and heat produced by said rubbing.

What is claimed is:

1. In a flexible card whose surface contains printed information concealed by an opaque coating, the improvement comprising a layer of abrasive material on said card for abrading said opaque coating to expose said printed information when said card is folded, bringing said layer of abrasive material into contact with said removable opaque coating.

2. A card in accordance with claim 1 in which said layer of abrasive material is further capable of retaining material from said opaque coating upon separation thereof from said card.

3. A card in accordance with claim 1 in which said layer of abrasive material is comprised of a sheet of abrasive material affixed to said card.

4. A card whose surface contains printed information concealed by a removable opaque coating, the improvement comprising a layer of abrasive material on said card for abrading said opaque coating to expose said printed information, and a perforated line separating said layer of abrasive material from the region of said card containing said removable opaque coating to facilitate detachment of said layer of abrasive material from said card.

* * * * *